US006584429B1

(12) United States Patent
Lang

(10) Patent No.: US 6,584,429 B1
(45) Date of Patent: Jun. 24, 2003

(54) INPUT/LOSS METHOD FOR DETERMINING BOILER EFFICIENCY OF A FOSSIL-FIRED SYSTEM

(75) Inventor: Fred D. Lang, San Rafael, CA (US)

(73) Assignee: Exergetic Systems LLC, San Rafael, CA (US)

( * ) Notice: Subject to any disclaimer, the term of this patent is extended or adjusted under 35 U.S.C. 154(b) by 316 days.

(21) Appl. No.: 09/630,853

(22) Filed: Aug. 2, 2000

Related U.S. Application Data

(60) Provisional application No. 60/147,717, filed on Aug. 6, 1999.

(51) Int. Cl.[7] ..... G06F 15/46; G06F 15/00

(52) U.S. Cl. ..... 702/182; 702/31; 374/43; 700/274

(58) Field of Search ..... 702/31, 32, 40, 702/45, 50, 55, 99, 100, 130, 132, 134, 136, 182, 183, 188; 374/36, 43, 45; 700/274, 275, 282

(56) References Cited

U.S. PATENT DOCUMENTS

| | | | | | |
|---|---|---|---|---|---|
| 4,941,345 | A | * | 7/1990 | Altemark et al. | 73/23.2 |
| 5,367,470 | A | * | 11/1994 | Lang | 431/12 |
| 5,513,519 | A | * | 5/1996 | Cauger et al. | 702/136 |
| 5,790,420 | A | * | 8/1998 | Lang | 700/287 |
| 2001/0021883 | A1 | * | 9/2001 | Lang | 700/274 |

* cited by examiner

*Primary Examiner*—Marc S. Hoff
*Assistant Examiner*—Manuel L. Barbee
(74) *Attorney, Agent, or Firm*—Gary Hoenig

(57) ABSTRACT

The operation of a fossil-fueled thermal system is quantified by obtaining an unusually accurate boiler efficiency. Such a boiler efficiency is dependent on the calorimetric temperature at which the fuel's heating value is determined. This dependency affects the major thermodynamic terms comprising boiler efficiency.

14 Claims, 1 Drawing Sheet

INPUT/LOSS METHOD FOR DETERMINING BOILER EFFICIENCY OF A FOSSIL-FIRED SYSTEM

This application claims the benefit of U.S. Provisional Application No. 60/147,717 filed Aug. 6, 1999, the disclosure of which is hereby incorporated herein by reference.

This invention relates to a fossil-fired boiler, and, more particularly, to a method for determining its thermal efficiency to a high accuracy from its basic operating parameters.

CROSS REFERENCES

This application is related to U.S. Pat. Nos. 5,367,470 and 5,790,420 which patents are incorporated herein by reference in their entirely. Performance Test Codes 4.1 and 4 published by the American Society of Mechanical Engineers (ASME) are incorporated herein by reference in their entirely.

BACKGROUND OF THE INVENTION

The importance of accurately determining boiler efficiency is critical to any thermal system which heats a fluid by combustion of a fossil fuel. If practical day-to-day improvements in thermal efficiency are to be made, and/or problems in thermally degraded equipment are to be found and corrected, then accuracy in efficiency is a necessity.

The importance of accurately determining boiler efficiency is also critical to the Input/Loss Method. The Input/Loss Method is a patented process which allows for complete thermal understanding of a steam generator through explicit determinations of fuel and effluent flows, fuel chemistry including ash, fuel heating value and thermal efficiency. Fuel and effluent flows are not directly measured. The Method is designed for on-line monitoring, and hence continuous improvement of system heat rate.

The tracking of the efficiency of any thermal system, from a classical industrial view-point, lies in measuring its useful thermal output, BBTC, and the inflow of fuel energy, $m_{AF}$(HHVP+HBC). $m_{AF}$ is the mass flow of fuel, HHVP is the fuel's heating value, and HBC is the Firing Correction term. For example, the useful output from a fossil-fired steam generator is its production of steam energy flow. Boiler efficiency ($\eta_{B\text{-}HHV}$) is given by: $\eta_{B\text{-}HHV}$=BBTC/[$m_{AF}$(HHVP+HBC)]. The measuring of the useful output of thermal systems is highly developed and involves the direct determination of useful thermal energy flow. Determining thermal energy flow generally involves measurement of the inlet and outlet pressures, temperatures and/or qualities of the fluids being heated, as well as measurement of the fluid's mass flow rates ($m_{stm}$). From this information specific enthalpies (h) may be determined, and thus the total thermal energy flow, BBTC=$\Sigma m_{stm}(h_{outlet}-h_{inlet})$, delivered from the combustion gases may be determined.

However, when evaluating the total inflow of fuel energy, problems frequently arise when measuring the flow rate ($m_{AF}$) of a bulk fuel such as coal. Further, the energy content of coal, its heating value (HHV), is often not known with sufficient accuracy. When such difficulties arise, it is common practice to evaluate boiler efficiency based on thermal losses per unit mass flow of As-Fired fuel (i.e., Btu/lbm$_{AF}$); where: $\eta_{B\text{-}HHV}$=1.0−($\Sigma$Losses/$m_{AF}$)/(HHVP+HBC). For evaluating the individual terms comprising boiler efficiency, such as the specific loss term ($\Sigma$Losses/$m_{AF}$), there are available numerous methods developed over the past 100 years. One of the most encompassing is offered by the American Society of Mechanical Engineers (ASME), published in their Performance Test Codes (PTC).

INTRODUCTION TO NEW APPROACH

This invention teaches the determination of boiler efficiency having enhanced accuracy. Boiler efficiency, if thermodynamically accurate, will guarantee consistent system mass/energy balances. From such consistencies, fuel flow and effluent flow then may be determined, having greater accuracy than prior art, and greater accuracy than obtained from direct measurements of these flows.

Before discussing details of the present invention it is useful to examine ASME's PTC 4.1, Steam Generating Units, and PTC 4, Fired Steam Generators. Both PTC study a boiler efficiency based on the higher heating value ($\eta_{B\text{-}HHV}$), no mention is made of a lower heating value based efficiency ($\eta_{B\text{-}LHV}$). Using PTC 4.1's Heat-Loss Method, higher heating value efficiency is defined by the following. For Eq. (1A), HHV, if determined from a constant volume bomb calorimeter, is corrected for a constant pressure process, termed HHVP. Gaseous fuel heating values, normally determined assuming a constant pressure process, need no such correction, HHVP=HHV.

$$\eta_{B-HHV} = \frac{HHVP + HBC - \sum Losses/m_{AF}}{HHVP + HBC} \tag{1A}$$

Using PTC 4's Heat-Balance Method, higher heating value efficiency is defined as:

$$\eta_{B-HHV/fuel} = \frac{HHVP - \sum Losses/m_{AF}}{HHVP} \tag{1B}$$

The above are considered indirect means of determining boiler efficiency. Eq. (1A) implies that the input energy in fuel & Firing Correction $m_{AF}$(HHVP+HBC) less $\Sigma$Losses, describes the "Energy Flow Delivered" from the thermal system, the term BBTC. The newer PTC 4 (1998, but first released in 2000) advocates only the use of heating value in the denominator, developing a so-called "fuel" efficiency, $\eta_{B\text{-}HHV/fuel}$. It is important to recognize that once efficiency is determined using an indirect means, fuel flow may be back-calculated using the classic definition provided BBTC is determinable: $m_{AF}$=BBTC/[$\eta_{B\text{-}HHV}$(HHVP+HBC)]; or $m_{AF}$=BBTC/[$\eta_{B\text{-}HHV/fuel}$HHVP].

The concept of the Enthalpies of Products and Reactants is now introduced as important to this invention. These terms both define heating value and justify the Firing Correction term (HBC) as being intrinsically required in Eq. (1A) Higher heating value is the amount of energy released given complete, or "ideal", combustion at a defined "calorimetric temperature". For a solid fuel such as coal, evaluated in a constant volume bomb, the combustion process typically heats a water jacket about, and is corrected to, the calorimetric temperature. Any such ideal combustion process is the difference between the enthalpy of ideal products ($HPR_{Ideal}$) less reactants ($HRX_{Cal}$) both evaluated at the calorimetric temperature, $T_{Cal}$. Correction from a constant volume process (HHV) associated with a bomb calorimeter, if applicable, to a constant pressure process (HHVP) associated with the As-Fired condition is made with the $\Delta H_{V/P}$ term, see Eq. (37B).

$$\oint \delta Q_{T\text{-}Cal} = -HHV = -HHVP + \Delta H_{V/P} \tag{2A}$$

$$HHVP \equiv = -HPR_{Ideal} + HRX_{Cal} \tag{2B}$$

This invention teaches that only when fuel is actually fired at exactly $T_{Cal}$, and whose combustion products are cooled to exactly $T_{Cal}$, is the thermodynamic definition of heating value strictly conserved. At any other firing and cooling temperatures, Firing Correction and sensible heat losses must be applied. At any other temperature the so-called "fuel" efficiency (which ignores the HBC correction), is thermodynamically inconsistent. At any other temperature, evaluation of the $HRX_{Cal}$ term must be corrected to the actual As-Fired condition through a Firing Correction referenced to $T_{Cal}$. The $HPR_{Ideal}$ term is corrected to the actual via loss terms referenced to $T_{Cal}$ where appropriate (that is, anywhere a Δenergy term is applicable).

When a fossil fuel is fired at a temperature other than $T_{Cal}$, the Firing Correction term HBC must be added to each side of Eq. (2B):

$$HHVP+HBC=-HPR_{Ideal}+HRX_{Cal}+HBC \tag{3A}$$

Eq. (3A) implies that for any As-Fired condition, the systems' thermal efficiency is unity, provided the $HPR_{Ideal}$ term is conserved (i.e., system losses are zero, and ideal products being produced at $T_{Cal}$). For an actual combustion process, the $HPR_{Ideal}$ term of Eq. (3A) is then corrected for system losses, forming the basis of boiler efficiency:

$$\eta_{B\text{-}HHV}(HHVP+HBC)=-HPR_{Ideal}-\Sigma\text{Losses}/m_{AF}+HRX_{Cal}+HBC \tag{3B}$$

This invention recognizes that the $HPR_{Ideal}$ term of Eqs. (2B) & (3A), and thus Eq. (3B), is key in accurately computing boiler efficiency stemming from Eq. (3B). This invention teaches that all terms comprising Eq. (3B) must be evaluated with methodology consistent with a boiler's energy flows, but also, and most importantly, in such a manner as to not impair the numerical consistency of the $HPR_{Ideal}$ term as referenced to $T_{Cal}$.

The approaches contained in prior art have not appreciated using the concept of $T_{Cal}$, used for thermodynamic reference of energy levels as affecting the major terms comprising boiler efficiency. It is believed that prior approaches evaluated fuel heating value, and especially that of coal, only to classify fuels. Boiler efficiencies were determined as relative quantities. Accuracy in heating value, and in the resultant computed fuel flow, was not required but only accuracy in the total system fuel inflow of energy was desired. The accuracy needed in boiler efficiency by the Input/Loss Method, given that fuel chemistry, fuel heating value and fuel flow are all computed, requires the method of this invention. Further, commercial needs for high accuracy boiler efficiency was not required until recent deregulation of the electric power industry which has now necessitated improved accuracy.

The sign convention associated with the HPR & HRX terms of Eq. (2B) follows the assumed convention of a positive numerical heating value, thus the non-conventional sense of HPR & HRX. In some technical literature the senses of HPR & HRX terms may be found reversed for simplicity of presentation. An example of typical values includes: $[-HPR_{Act\text{-}HHV}+HRX_{Act\text{-}HHV}]=-(-7664)+(-1064)$, Btu/lbm. The sign of sensible heat terms, ∫dh, follows this difference: $-HPR_{Act}-\int dh_{Products}$; and $+HRX_{Act}+\int dh_{Reactants}$. Heats of Formation, $\Delta H_f^0$, are always negative quantities. From Eq. (3B), higher heating value boiler efficiency is then given by:

$$\eta_{B-HHV}=\frac{-HPR_{Ideal}-\sum Losses/m_{AF}+HRX_{Cal}+HBC}{HHVP+HBC} \tag{3C}$$

For certain fuels the PTC procedures are flawed by not recognizing the calorimetric temperature, $T_{Cal}$, and its impact on the $HPR_{Ideal}$ term. As discussed below, for certain coals having high fuel water, and for gaseous fuels, use of the calorimetric temperature becomes mandated if using the methods of this invention for accurate boiler efficiencies; without such consideration, errors will occur. There is no mention of the calorimetric temperature in PTC 4.1 nor in PTC 4. PTC 4.1 references energy flows to an arbitrary "reference air temperature", $T_{RA}$. PTC 4 references energy flows to a constant 77.0F. PTC 4.1 nor 4 mention how the reference temperature should be evaluated. U.S. Pat. No. 5,790,420 (bottom of col.18) also assumes a constant reference temperature at 77.0F, without mention of a variable calorimetric temperature, nor how the reference temperature should be evaluated. There is no mention of a calorimetric temperature as used in boiler efficiency calculations in the technical literature. Further, the PTC 4 procedure is flawed by recommending a so-called "fuel" efficiency, which, again, is in disagreement with the base definition of heating value if the fuel is actually fired (As-Fired) at a temperature other than $T_{Cal}$. For some high energy coals the effects of ignoring $T_{Cal}$ have minor impact. However, when using coals having high water contents (e.g., lignites commonly found in eastern Europe and Asia), and for gaseous fuels, such effects may become very important.

To illustrate, consider a simple system firing pure carbon in dry air, having losses only of dry gas, effluent CO and unburned carbon. Assume Forced Draft (FD) and Induced Draft (ID) fans are used having $W_{FD}$ & $W_{ID}$ energy flows. Applying PTC 4.1 §7.3.2.02, but using nomenclature herein, dry gas loss is evaluated at the reference air temperature, thus $L_{G'}$ in Btu/$lbm_{AF}$ is given by:

$$L_{G'}=C_{P/Gas}(T_{Stack}-T_{RA})M'_{Gas} \tag{4}$$

Incomplete combustion is described (§7.3.2.07) as the fraction of CO produced relative to total possible effluent $CO_2$ times the difference in Heats of Combustion of carbon and CO.

$$L_{CO}=(-\Delta H_{f\text{-}Cal/CO2}{}^{0}+\Delta H_{f\text{-}Cal/CO}{}^{0})M'_{CO} \tag{5}$$

Unburned carbon is described in PTC 4.1 §7.3.2.07, as the flow of refuse carbon times its Heat of Combustion:

$$L_{UC}=(-\Delta H_{f\text{-}Cal/CO2}{}^{0})M'_{C/Fly} \tag{6}$$

For this simple example, and assuming unity fuel flow, the so-called "boiler credits" as defined, in part, by PTC 4.1 are determined as:

$$HBC'=C_{P/Fuel}(T_{Fuel}-T_{RA})+C_{P/Air}(T_{Amb}-T_{RA})M'_{Air}+W_{FD} \tag{7}$$

In these equations the $M'_i$ weight fractions are relative to As-Fired fuel, and have direct translation to 4.1 usage. PTC 4.1 efficiency is then given by the following, after combining the above quantities into Eq. (3C), and re-arranging terms:

$$\eta_B = \frac{-HPR_{Ideal} - C_{P/Gas}(T_{Stack} - T_{RA})M'_{Gas} - W_{ID} - (-\Delta H^0_{f-Cal/CO2} + \Delta H^0_{f-Cal/CO})M'_{CO} - (-\Delta H^0_{f-Cal/CO2})M'_{C/Fly} + HRX_{Cal} + C_{P/Fuel}(T_{Fuel} - T_{RA}) + C_{P/Air}(T_{Amb} - T_{RA})M'_{Air} + W_{FD}}{HHVP + HBC} \quad (8)$$

The present invention is a complete departure from all known approaches in determining boiler efficiency, including PTC 4.1 and PTC 4. Eq. (8) illustrates the generic approach followed by PTC 4.1 and PTC 4, which has been used by the power industry for many years. However, this invention recognizes and corrects several discrepancies which affect accuracy. These discrepancies include the following items.

1) The enthalpy terms $HPR_{Ideal}$ & $HRX_{Cal}$ as referenced to the calibration temperature, when "corrected" to system boundary conditions using ($T_{Stack}$–$T_{RA}$) & ($T_{Fuel}$–$T_{RA}$) is wrong since $T_{RA} \neq T_{Cal}$. Although the effects on $HPR_{Ideal}$ from HBC referenced to $T_{RA}$, may cancel; the effects on $HPR_{Ideal}$ from the ΣLosses/$m_{AF}$ term, as referenced to $T_{RA}$, does not cancel. See PTC 4.1 §7.2.8.3 & §7.3.2.02.
2) PTC 4.1 addresses unburned fuel and incomplete combustion through Heats of Combustion. Although numerically correct as referenced to $HPR_{Ideal}$, a more logical approach is to describe actual products—their effluent concentrations and specific Heats of Formation, $\Delta H_{f\text{-}Cal}^0$. For example, although the above $M'_{Gas}$. is descriptive of actual combustion products, differences between actual and ideal demand numerical consistency with HHVP, product formations and associated heat capacities. See PTC 4.1 §7.3.2.01, –07.
3) Uncertainty is present when using Heats of Combustion associated with unburned fuel. As coal pyrolysis creates numerous chemical forms (the breakage of aliphatic C—C bonds, elimination of heterocycle complexes, the hydrogenation of phenols to aromatics, etc.), the assumption of an encompassing $\Delta H_C^0$ used by PTC 4.1 is optimistic. For example, various graphites have a wide variety of $\Delta H_C^0$ values (from 13,970 to 14,540 Btu/lb depending on manufacturing processes). An improved approach is use of consistent Heats of Formation coupled with measured effluent gas concentrations and balanced stoichiometrics.
4) HHVP reflects formation of ideal combustion products at $T_{Cal}$; water thus formed must be referenced to $\Delta H_{f\text{-}Cal/liq}^0$ and $h_{f\text{-}Cal}$ (not illustrated above). For example, if using $T_{RA}$ as reference, water's $\Delta H_{f/liq}^0$ varies from –6836.85 Btu/lbm at 40F to –6811.48 Btu/lbm at 100F, $h_f$ from 8.02 to 68.05 Btu/lbm. Holding these terms constant is suggested by PTC 4.1 §7.3.2.04.
5) PTC 4.1 §7.3.2.13 pulverizer rejected fuel losses are described by the rejects weight fraction times rejects heating value, $HHV_{Rej}$ (not illustrated above). This is correct only if the heating value is the same as the As-Fired. If mineral matter is concentrated in the rejects (reflected by a $HHV_{Rej}$ term), then fuel chemistry (and HPR & HRX terms) must be adjusted, again, to conserve $HPR_{Ideal}$ for the As-Fired.

Of course, one could equate $T_{RA}$ to $T_{Cal}$ (not suggested by PTC 4.1 or 4), and solve some of the problems. However, the rearrangement of individual terms of Eq. (8) and then, most importantly, their combinations into $HPR_{Act}$, $HRX_{Act}$ and HBC terms evaluated at $T_{Cal}$, provides the nucleus for this invention. These methods are not employed by any known procedure. First, the issue of possible inconsistency between ideal arid actual products is addressed by simplifying (for the example cited) the entire numerator of Eq. (8) to [$-HPR_{Act}$+$HRX_{Act}$]. In this, the Enthalpy of Products, $HPR_{Act}$, encompasses effluent sensible heat and $\Delta H_{f\text{-}Cal}^0$ terms associated with actual products, including all terms associated with incomplete combustion. The Enthalpy of Reactants, $HRX_{Act}$, is defined as [$HRX_{Cal}$+HBC], the last line of Eq. (8); $HRX_{Cal}$ is evaluated as [HHVP+$HPR_{Ideal}$] from Eq. (2B). Second, use of the [$-HPR_{Act}$+$HRX_{Act}$] concept allows ready introduction of the calorimetric temperature (or any reference temperature if applicable) as affecting both ∫dh and $\Delta H_{f\text{-}Cal}^0$ terms. Third, the [$-HPR_{Act}$+$HRX_{Act}$] concept provides generic methodology for any combustion situation. It is believed the elimination of individual loss terms associated with combustion (cornionly used by the industry and as practiced in PTC 4.1 and PTC 4) greatly reduces error in determining total stack losses, including the significant dry stack gas loss term as will be seen; [$-HPR_{Act}$+$HRX_{Act}$]=HHVP+HBC−Σ(Stack Losses)/$m_{AF}$.

The use of the term "boiler credit" (for HBC') as used by the PTCs is misleading since terms comprising HBC intrinsically correct the fuel's calorimetric energy base to As-Fired conditions. HBC is herein termed the "Firing Correction". HBC is not a convenience nor arbitrary, it is required for HHVP consistency and thus valid boiler efficiencies leading to consistent mass and energy balances.

Although the basic philosophies of PTC 4.1 and 4 are useful and have been employed throughout the power industry, including prior Input/Loss Methods, they are not thermodynamically consistent. To address these issues this invention includes establishing an ordered approach to boiler efficiency calculations employing a strict definition of heating value, that is, consistent treatment of the Enthalpy of Products, the Enthaply of Reactants and the Firing Correction such that the numerical evaluation of the $HPR_{Ideal}$ term is conserved.

This invention teaches the determination of lower heating value based boiler efficiency (commonly used in Europe, Asia, South America and Africa), such that fuel flow rate is computed the same from either a lower or a higher heating value based efficiency.

Other advantages of this invention will become apparent when the details of the method of the present invention is considered.

SUMMARY OF INVENTION

This invention teaches the consistent application of the calorimetric temperature to the major terms comprising determination of boiler efficiency. The preferred method of the application of such a temperature is through the explicit calculation of these major terms, which include the Enthalpy of Products, $HPR_{Act}$, the Enthalpy of Reactants, $HRX_{Act}$, and the enthalpy of Firing Correction, HBC. This method advocates an ordered and systematic approach to the determination of boiler efficiency. For some fuels, under certain conditions, techniques of this invention may be applied using an arbitrary reference temperature.

DETAILED DESCRIPTION OF INVENTION

Figure 1:
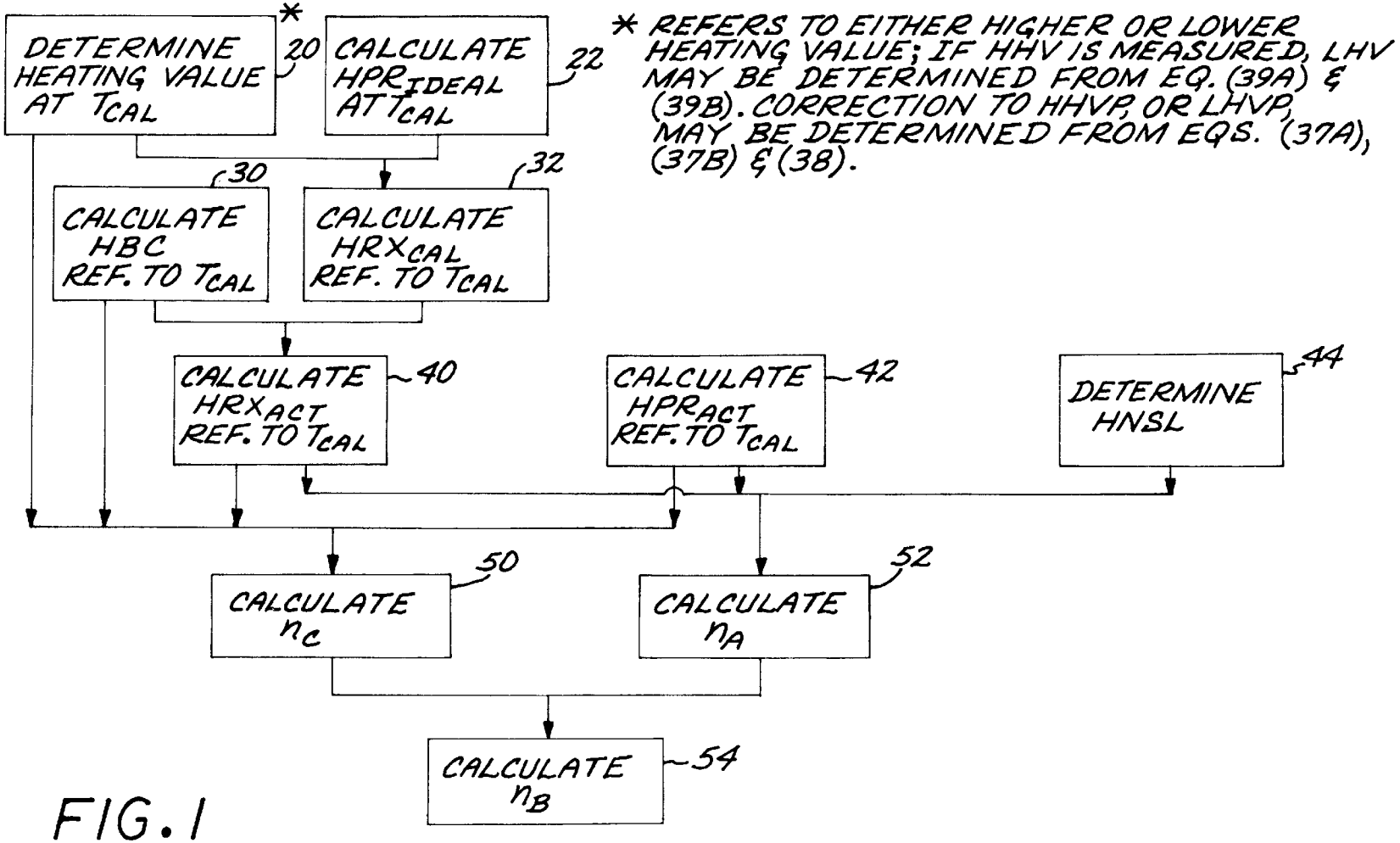
FIG. 1 is a block flow diagram illustrating the approach of the invention.

Definitions of Equation Terms with Typical Units of Measure:

Molar Ouantities Related to Stoichiometrics x=Moles of As-fired fuel per 100 moles of dry gas product (the assumed solution "base").

a=Molar fraction of combustion $O_2$, moles/base.

$n_i$=Molar quantity of substance i, moles/base.

$N_j$=Molecular weight of compound j.

$\alpha_k$=As-Fired (wet-base) fuel constituent per mole of fuel $\Sigma\alpha_k=1.0$; k=0, 1, 2, . . . 10.

$b_A$=Moisture in entering combustion air, moles/base.

$\beta b_A$=Moisture entering with air leakage, mole/base.

$b_Z$=Water/steam in-leakage from working fluid, moles/base.

$b_{PLS}$=Molar fraction of Pure LimeStone ($CaCO_3$) required for zero CaO production, moles/base.

$\gamma$=Molar ratio of excess $CaCO_3$ to stoichiometric $CaCO_3$ (e.g., $\gamma$=0.0 if no effluent CaO).

z=Moles of $H_2O$ per effluent $CaSO_4$, based on lab tests.

$\sigma$=Kronecker function: unity if $(\alpha_6+\alpha_9)>0.0$, zero if no sulfur is present in the fuel.

$\beta$=Air pre-heater dilution factor, a ratio of air leakage to true combustion air, molar ratio.

$\beta=(R_{Act}-1.0)/[aR_{Act}(1.0+\phi_{Act})]$ $R_{Act}$=Ratio of total moles of dry gas from the combustion process before entering the air pre-heater to gas leaving; defined as the air pre-heater leakage factor.

$\phi_{Act}$=Ratio of non-oxygen gases (nitrogen and argon) to oxygen in the combustion air, molar ratio.

$\phi_{Act}\equiv(1.0-A_{Act})/A_{Act}$ $A_{Act}$=Concentration of $O_2$ in the combustion air local to (and entering) the system, molar ratio.

Ouantities Related to System Terms

BBTC=Energy Flow Delivered derived directly from the combined combustion process and those energy flows which immediately effect the combustion process, Btu/hr.

$C_{P-i}$=Heat capacity for a specific substance i, Btu/lb−ΔF.

HBC≡Firing Correction, Btu/$lbm_{AF}$.

HBC'≡Boiler Credits defined in ASME PTC 4.1, Btu/$lbm_{AF}$.

$\Delta H_{f-77}^{0}$=Heat of Formation at 77.0 F, Btu/lbm or Btu/lb-mole $\Delta H_{f-Cal}^{0}$=Heat of Formation at $T_{Cal}$, Btu/lbm or Btu/lb-mole.

HHV=Measured or calculated higher heating value, also termed the gross calorific value, Btu/$lbm_{AF}$.

HHVP=As-Fired (wet-base) higher heating value, based on HHV, corrected for constant pressure process, Btu/$lbm_{AF}$.

HNSL≡Non-Chemistry & Sensible Heat Losses, Btu/$lbm_{AF}$.

HPR≡Enthalpy of Products from combustion (HHV- or LHV-based), Btu/$lbm_{AF}$.

HRX≡Enthalpy of Reactants (HHV- or LHV-based), Btu/$lbm_{AF}$.

HR=System heat rate, Btu/kWh.

HSL≡Stack Losses (HHV- or LHV-based), Btu/$lbm_{AF}$.

$L_i$=Specific heat loss term for a ith process, Btu/$lbm_{AF}$.

LHV=Lower heating value based on measurement, calculation or based on the measured or calculated higher heating value, LHV is also termed the net calorific value, Btu/$lbm_{AF}$.

LHVP=As-Fired (wet-base) lower heating value, based on LHV, corrected for a constant pressure process, Btu/$lbm_{AF}$.

$M'_i$=Weight fraction of ith effluent or combustion air relative to As-Fired fuel, —.

$m_{AF}$≡As-Fired fuel mass flow rate (wet with ash), $lbm_{AF}$/hr.

$Q_{SAH}$=Energy flow delivered to steam/air heaters, Btu/hr.

$P_{Amb}$≡Ambient pressure local to the system, psiA.

$T_{Amb}$≡Ambient temperature local to the system, F.

$T_{Cal}$≡Calorimetric temperature to which heating value is referenced, F.

$T_{AF}$=As-Fired fuel temperature, F.

$T_{RA}$≡Reference air temperature to which sensible heat losses and credits are compared (defined by PTC 4.1), F.

$T_{Slack}$≡Boundary temperature of the system effluents, commonly taken as the "stack" temperature, F.

$W_{FD}$=Brake power associated with inflow stream fans (e.g., Forced Draft fans) within the system boundary, Btu/hr.

$W_{ID}$=Brake power associated with outflow stream fans (e.g., Induced Draft & gas recirculation fans), Btu/hr.

$WF_k$=Weight fraction of component k, —.

$\eta_B$=Boiler efficiency (HHV- or LHV-based), —.

$\eta_C$=Combustion efficiency (HHV- or LHV-based), —.

$\eta_A$=Boiler absorption efficiency, —.

Introduction to Boiler Efficiency

The preferred embodiment for determining boiler efficiency, $\eta_B$, divides its definition into two components, a combustion efficiency and boiler absorption efficiency. This was done such that an explicit calculation of the major terms, as solely impacting combustion efficiency, could be formulated. This invention teaches the separation of stack losses (treated by terms effecting combustion efficiency), from non-stack losses (treated by terms effecting boiler absorption efficiency).

$$\eta_B=\eta_C\eta_A \tag{9}$$

To develop the combustion efficiency term, the Input/Loss Method employs an energy balance uniquely about the flue gas stream (i.e., the combustion process). This balance is based on the difference in enthalpy between actual products $HPR_{Act}$, and actual reactants $HRX_{Act}$. Actual, As-Fired, Enthalpy of Reactants is defined in terms of Firing Correction: $HRX_{Act}\equiv HRX_{Cal}+HBC$. Combustion efficiency is defined by terms which are independent of fuel flow. Its terms are integrally connected with the combustion equation, Eq. (19) discussed below.

$$\eta_{C-HHV} \equiv \frac{-HPR_{Act}+HRX_{Act}}{HHVP+HBC} \tag{10}$$

This formulation was developed to maximize accuracy. Typically for coal-fired units, typically over 90% of the boiler efficiency's numerical value is comprised of $\eta_C$. All individual terms comprising $\eta_C$ have the potential of being determined with high accuracy. $HPR_{Act}$ is determined knowing effluent temperature, complete stoichiometric balances, and accurate combustion gas, air and water thermodynamic properties. $RRX_{Act}$ is dependent on $HPR_{Ideal}$, heating value and the Firing Correction. HBC applies the needed corrections for the reactant's sensible heat: fuel, combustion air, limestone (or other sorbent injected into the combustion process), water in-leakage and energy inflows . . . all referenced to $T_{Cal}$ (detailed below).

The boiler absorption efficiency is developed from the boiler's "non-chemistry & sensible heat loss" term, HNSL, i.e., product sensible heat of non-combustion processes associated with system outflows. It is defined such that it, through iterative techniques, may be computed independent of fuel flow:

$$\eta_A \equiv 1.0 - \frac{HNSL}{-HPR_{Act} + HRX_{Act}} \tag{11}$$

$$= 1.0 - \frac{HNSL}{\eta_{C-HHV}(HHVP + HBC)} \tag{12}$$

HNSL comprises radiation & convection losses, pulverizer rejected fuel losses (or fuel preparation processes), and sensible heats in: bottom ash, fly ash, effluent dust and effluent products of limestone (or other sorbent). HNSL is determined using a portion of PTC 4.1's Heat-Loss Method.

The definition of $\eta_A$ allows $\eta_B$ of Eq. (3C) to be evaluated using $HPR_{Act}$ & $HRX_{Act}$ terms, illustrating consistency with Eq. (1A), explained as follows. Since: $HSL \equiv HPR_{Act} - HPR_{Ideal}$; $[-HPR_{Act} + HRX_{Act}] = HHVP + HBC - HSL$; the following is evident:

$$\eta_{B-HHV} \equiv \left[\frac{-HPR_{Act} + HRX_{Act}}{HHVP + HBC}\right]\left[\frac{-HPR_{Act} + HRX_{Act} - HNSL}{-HPR_{Act} + HRX_{Act}}\right] \tag{13A}$$

$$= \frac{-HPR_{Act} + HRX_{Act} - HNSL}{HHVP + HBC} \tag{13B}$$

$$= \frac{HHVP + HBC - HSL - HNSL}{HHVP + HBC} \tag{13C}$$

$$= 1.0 - \frac{\Sigma\ Losses}{m_{AF}(HHVP + HBC)} \tag{13D}$$

$$= \frac{BBTC}{m_{AF}(HHVP + HBC)} \tag{13E}$$

where $\Sigma Losses \equiv m_{AF}(HSL + HNSL)$. The Energy Flow Delivered from the combustion process, BBTC, is $m_{AF}$ (HHVP+HBC) less ΣLosses.

Equating Eqs. (13B) and (13E) results in defining the specific Energy Flow Delivered, $BBTC/m_{AF}$. Since HNSL and BBTC are the same for either HHV- or LHV-based calculations, the enthalpy difference $[-HPR_{Act} + HRX_{Act}]$ must be identical.

$$-HPR_{Act-HHV} + HRX_{Act-HHV} \equiv -HPR_{Act-LHV} + HRX_{Act-LHV} \tag{14}$$

With a computed boiler efficiency, the As-Fired fuel flow rate, $m_{AF}$, may be back-calculated:

$$m_{AF} = \frac{BBTC}{\eta_{B-HHV}(HHVP + HBC)} \tag{15}$$

Assuming $T_{Cal}$ is not known and an arbitrary thermodynamic reference temperature ($T_{RA}$) must be used, $T_{Cal} = T_{RA}$, then the practicality of any boiler efficiency method should be demonstrated through the sensitivity of the denominator of Eq. (15) with its assumed reference temperature. Fuel flow, BBTC, and HHVP are constants for a given system evaluation. In regards to fuel flow, the use of an arbitrary $T_{RA}$ is compatible with the methods of this invention provided the computed fuel flow of Eq. (15) is demonstrably insensitive to a "reasonable change" in the thermodynamic reference temperature, $T_{RA}$. By "reasonable change" in the thermodynamic reference temperature is meant the likely range of the actual calorimetric temperature. For solid fuels this likely range is from 68F to 95F, or as otherwise would actually be used in practicing bomb calorimeters. For gaseous fuels, whose heating values are computed, not measured, this likely range is whatever would limit the variation in computed fuel flow to less than 0.10%. This invention teaches that the product $\eta_{B-HHV}$(HHVP+HBC) be demonstrably constant for any reasonable range of $T_{RA}$, if used. This is not to suggest that effects on $\eta_B$ and HR may be ignored if fuel flow is found insensitive; the insensitivity of $\eta_B$ and HR must be demonstrated through the $HPR_{Ideal}$ term, before a given $T_{RA}$ is justified. However, if $\eta_B$ is mis-evaluated through mis-application of $T_{RA}$, effects on fuel flow are not proportional given the influence of the HBC term evaluated using the methods of this invention. A 1% change in $\eta_B$ (e.g., 85% to 84%) caused by a change in $T_{RA}$ will typically produce a 0.2% to 0.4% change ($\Delta m_{AF}/m_{AF}$) in fuel flow, which is considered not acceptable. Further, Eq. (15) also illustrates that the use of a fuel efficiency (in which HBC≡0.0), in combination with an arbitrary reference temperature is flawed: since $\eta_B = f(T_{RA})$, and BBTC & HHVP are constants, changes in computed fuel flow are then proportional to $\eta_B$, and wrong.

Once fuel flow is correctly determined, stoichiometric balances are then used to resolve all boiler inlet and outlet mass flows, including effluent flows required for regulatory reporting. The computation of effluent flow is taught in U.S. Pat. No. 5,790,420, col.22, line 38 thru col.23, line 17; but without the benefit of high accuracy fuel flow as taught by this invention. System heat rate associated with a steam/electric power plant follows from Eq. (15) in the usual manner. The effects on HR given mis-application of $T_{RA}$ will compound (add) the erroneous effects from $\eta_B$ and fuel flow.

$$HR_{HHV} \equiv m_{AF}(HHVP + HBC)/Power \tag{16}$$

$$= BBTC/(\eta_{B-HHV}\ Power) \tag{17}$$

Given the commercial importance of computing fuel & emission flows for industrial systems, and determining system heat rate consistent with these flows, accurately determining boiler efficiency is important (upon which these quantities are based). The determination of on-line fuel heating values, coupled to sophisticated error analysis as used by the Input/Loss Method, demands integration of stoichiometrics with high accuracy boiler efficiency.

Foundation Principles and Nomenclature

To assist in understanding, discussed is the determination of Heats of Formation evaluated at $T_{Cal}$. By international convention, standardized Heats of Formation are referenced to 77F (25C) and 1.00 bar pressure. For typical fossil combustion, pressure corrections are justifiably ignored. To convert to any temperature from 77F the following approach is used:

$$\Delta H^0_{f-T} = \Delta H^0_{f-77} + \int_{77}^{T} dh_{Compound} - \sum \int_{77}^{T} dh_{Elements} \tag{18}$$

Use of the 77F-base standard is important as it allows consistency with published values. Consistent $\Delta H_{f-T}{}^0$ values for $CO_2$, $SO_2$ and $H_2O$ allow consistent evaluations of the $HPR_{Ideal}$ term, and the difference between the As-Fired heating value plus Firing Correction and $[-HPR_{Act}+HRX_{Act}]$ . . . thus intrinsically accounting for stack losses and the vagaries of coal pyrolysis given unburned fuel. The finest compilation of Heats of Formulation and other properties is the so-called CODATA work (Cox, Wagman, & Medvedev, *CODATA Key Values for Thermodynamics*, Hemisphere Publishing Corp., New York, 1989). Enthalpy integrals used in Eq. (18) and elsewhere herein are obtained from the work of Passert & Danner (*Industrial Eninee Chemistry, Process Desin and Develoment*, Volume 11, No. 4, 1972; also see *Manual for Predicting Chemical Process Design Data*, Chapter 5, AIChE, N.Y., 1983, revised 1986). All fluid components in the thermal system (e.g., combustion gases, water in the combustion effluent, moist combustion air, gaseous constituents of air) must use a consistent dead state for thermodynamic property evaluations. Preferred methods employ 32.018F as a uniform dead state temperature, $T_{Dead}$, and 0.08872 psiA pressure, for all properties (e.g., the defined zero enthalpy for dry air, gaseous compounds, saturated liquid water, etc.). Thermodynamic properties are evaluated in the usual manner, for example from $T_{Dead}$ to $T_{Cal}$, and from $T_{Dead}$ to $T_{Stack}$, thus net the evaluation from $T_{Cal}$ to $T_{Stack}$.

Given such foundations, Eq. (18) with CODATA, Heats of Combustion of gaseous fuels, given their known chemistries, may be computed for any calorimetric temperature (e.g., at the industrial standard of 60F & 14.73 psia; see ASTM D1071 & GPA 2145). Solid and liquid fuel heating values, determined by test using an adiabatic or isoperibol bomb calorimeter, are in theory referenced to 68.0F (20C). Refer to ASTM D271, D1989, D2015 & D3286 for coals (being replaced by D5865), and ASTM D240 for liquid fuels. The 68F reference for solid fuels is rarely practiced; typically, coal bombs are typically conducted at 82.5F or 95F. Knowing the calorimetric temperature, if using this temperature in strict compliance with the definition of heating value, all system energies affecting boiler efficiency may then be computed.

The following combustion equation is presented for assistance in understanding nomenclature used in the detailing procedures. Refer to U.S. Pat. No. 5,790,420 for additional details. The nomenclature used is unique in that brackets are included for clarity. For example, the expression "$\alpha_2[H_2O]$" means the fuel moles of water, algebraically $\alpha_2$. The quantities comprising the combustion equation are based on 100 moles of dry gaseous product.

Details of Boiler Efficiency Calculations

The following paragraphs discuss detailed procedures associated with the Input/Loss Method of determining boiler efficiency. The Firing Correction is closely defined and only relates to terms correcting $HRX_{Cal}$.

Absorption efficiency, $\eta_A$, is based on the non-chemistry & sensible heat loss term, HNSL, whose evaluation employs several PTC 4.1 procedures. HNSL is defined by the following:

$$HNSL \equiv L_\beta + L_p + L_{d/Fly} + L_{d/Prec} + L_{d/Ca} + L_r + W_{ID}/m_{AF} \tag{20}$$

HNSL bears the same numerical value for both higher or lower heating value calculations, as does $\eta_A$. Differences with PTC 4.1 and PTC 4 procedures include: $L_\beta$ is referenced to the total gross (corrected) higher heat input, (HHVP+HBC), not HHV; the $L_W$ term is combined with the ash pit term $L_p$; $L_{d/Fly}$ is sensible heat in fly ash; $L_{d/Prec}$ is the sensible heat in stack dust at collection (the assumed electrostatic precipitator), considered a separate stream from fly ash; and $L_{d/Ca}$ is the sensible heat of effluents from sorbent injection if used (e.g., $CaSO_4.zH_2O$ and CaO effluents given limestone injection). $L_r$ and $W_{ID}$ are discussed below. All terms of Eq. (20) are evaluated relative to unity As-Fired fuel. Numerical checks of all effluent ash is made against fuel mineral content (and optionally may re-normalize the fuel's chemistry).

The radiation & convection factor, $\beta_{R\&C}$, is determined using either the American Boiler Manufacturers' curve (PTC 4.1), or its equivalence may be derived based on the work of Gerhart, Heil & Phillips (ASME, 1991-JPGC-Ptc-1), or its equivalence may be based on direct measurement or judgement. The resulting $L_\beta$ loss is always determined using the higher heating value:

$$L_\beta \equiv \beta_{R\&C}(HHVP+HBC) \tag{21A}$$

$L_\beta$ is then applied to either lower or higher heating value efficiencies through HNSL.

The coal pulverizer rejects loss term, $L_r$, is referenced to the total gross (corrected) higher heating value of rejected fuel plus the Firing Correction, $HHVP_{Rej}$+HBC, given rejects contain condensed water. Further, it is assumed the grinding action may result in a concentration of mineral matter (commonly referred to as "ash") in the reject, thus the fuel chemistry is renormalized based on a corrected fuel ash, $\alpha_{10\text{-}corr}=f(WF'_{Ash\text{-}AF})$; see Eq. (19). This is based on the weight fraction of ash downstream from the pulverizers (true $$\begin{aligned}
&x[\alpha_0[C_{YR}H_{ZR}] + \alpha_1[N_2] + \alpha_2[H_2O] + \alpha_3[O_2] + \alpha_4[C] + \alpha_5[H_2] + \alpha_6[S] + \alpha_7[CO_2] + \alpha_8[CO] + \alpha_9[H_2S] + \alpha_{10}[ash]]_{As\text{-}Fired\ Fuel} + \\
&b_Z[H_2O]_{In\text{-}Leakage} + [(1+\beta)(a[O_2] + a\phi_{Act}[N_2] + b_A[H_2O])]_{Air} + [(1-\gamma)b_{PLS}[CaCO_3]]_{As\text{-}Fired\ PLS} = \\
&d_{Act}[CO_2] + g_{Act}[O_2] + h[N_2] + j_{Act}[H_2O] + k_{Act}[SO_2] + \\
&[e_{Act}[CO] + f[H_2] + l[SO_3] + m[NO] + p[N_2O] + q[NO_2] + t[C_{YP1}H_{ZP1}] + u[C_{YP2}H_{ZP2}]]_{Minor\ Components} + x\alpha_{10}[ash] + \\
&\sigma b_{PLS}[CaSO_4 \cdot zH_2O] + [(1-\sigma+\gamma)b_{PLS}[CaO]]_{Excess\ PLS} + v[C_{Refuse}] + [\beta(a[O_2] + a\phi_{Act}[N_2] + b_A[H_2O])]_{Air\ Leakage}
\end{aligned} \tag{19}$$

Eq. (19) contains terms which allow consistent study of any combination of effluent data, especially the principle "actual" effluent measurements $d_{Act}$, $g_{Act}$, $j_{Act}$, and the system terms $\beta$, $\phi_{Act}$ & $R_{Act}$. By this is meant that data on either side of an air pre-heater may be employed, in any mix, with total consistency. This allows the stoichiometric base of Eq. (19), of 100 moles of dry gas, to be conserved at either side of the air pre-heater: dry stack gas=dry boiler=100 moles.

As-Fired), $WF'_{Ash\text{-}AF}$. $WF'_{Ash\text{-}AF}$ derives from: the weight fraction of rejects/fuel ratio, $WF_{Rej}$; ash in the supplied fuel, $WF_{Ash\text{-}Sup}$; and corrected heating values. For lower heating value computations, the ratio $HHV_{Rej}/HHV_{Sup}$ in Eq. (22A) is replaced by $LHV_{Rej}/LHV_{Sup}$.

$$L_r = WF_{Rej}(HHVP_{Rej}+HBC) \tag{21B}$$

$$WF'_{Ash-AF} = WF_{Ash-Sup} \cdot \frac{(1.0 - WF_{Rej} HHV_{Rej} / HHV_{Sup}) - (WF_{Rej} / WF_{Ash-Sup})(1.0 - HHV_{Rej} / HHV_{Sup})}{(1.0 - WF_{Rej})} \quad (22A)$$

The assumption of the reject loss being based on the higher heating value, although convenient for the HNSL term, implies, given the possibility of renormalized fuel chemistry, that the $HRX_{Act-LHV}$ term must be corrected for the fuel water's latent heat. This correction is described by Eq. (22C), applied in Eq. (22B) yielding a corrected LHVP. The $\Delta H_{L/H}$ term is evaluated using As-Fired chemistry downstream from the pulverizers, see Eq. (39B). Within Eq. (22C): $\xi \equiv (1.0-WF'_{Ash-AF})/(1.0-WF_{Ash-Sup})$. $\xi$ also corrects both Eq. (37B) & (39B). These same procedures are applicable for a fuel cleaning process where the fuel's mineral matter (ash) is removed.

$$LHVP = LHV + \Delta H_{V/P} - \Delta H_{corr-LHV} \quad (22B)$$

$$\Delta H_{corr-LHV} = \Delta H_{L/H}(\xi - 1.0)/\xi \quad (22C)$$

The steam/air heater energy flow term, $Q_{SAH}$, is assigned to HBC provided the system encompasses this heater, which it should as preferred. BBTC is defined in the classical manner (e.g., throttle less feedwater conditions, hot less cold reheat conditions). This is best seen by equating Eqs. (13B) & (13E), noting $HPR_{Act} = HPR_{Ideal} + HSL$:

$$BBTC = m_{AF}[-HPR_{Act} + HRX_{Act} - HNSL] \quad (22D)$$

$$= m_{AF}[-(HPR_{Ideal} + HSL) + (HRX_{Cal} + HBC) - HNSL] \quad (22E)$$

$$= m_{AF}[-HPR_{Ideal} + HRX_{Cal} + HBC - HSL - HNSL) \quad (22F)$$

If Eq. (2B), and its $HPR_{Ideal}$ term, is to be conserved, the right side of Eq. (22F) must be corrected for the total energy flow attributable to combustion: thus HBC includes the $+Q_{SAH}$ term, as must the BBTC term (resulting in a higher fuel flow). Although ($BBTC-Q_{SAH}$) is the net "useful" output from the system, BBTC is the total and directly derived energy flow from the combustion process applicable to $\eta_B$ . . . so defined such that Eqs. (13E) & (22D) are conserved. The HSL term of Eq. (22F) is not explicitly evaluated, discussed below.

The ID fan energy flow term, $W_{ID}$, given that thermal energy is imparted to the gas outflow stream (e.g., ID or recirculation fans), the $HPR_{Act}$ term must be corrected (through HNSL) such that the fuel's energy term $HPR_{Ideal}$ is again properly conserved.

The coal pulverizer shaft power is not accounted as no thermal energy is added to the fuel. Crushing coal increases its surface energy; for a generally brittle material, no appreciable changes in internal energy occur. The increased surface energy and any changes in internal energy are well accounted for through the process of determining heating value. If using ASTM D2013, coal samples are prepared by grinding to a #60 sieve (250 $\mu$m). Inconsistencies would arise if the bomb calorimeter samples were prepared atypical of actual firing conditions.

Miscellaneous shaft powers are not accounted if not affecting $HPR_{Act}$ or $HRX_{Act}$, i.e., not affecting the energy flow attributable to combustion. The use of "net" efficiencies or "net" heat rates, incorporating house electrical loads (the $B_{Xe}$ term of PTC 4.1), is not preferred for understanding the thermal performance of systems.

Having evaluated HNSL, the absorption efficiency is determined from either HHV- or LHV-based parameters:

$$\eta_A = 1.0 - \frac{HNSL}{-HPR_{Act-HHV} + HRX_{Act-HHV}} = 1.0 - \frac{HNSL}{-HPR_{Act-LHV} + HRX_{Act-LHV}} \quad (23)$$

All unburned fuel downstream of the combustion process proper (e.g., carbon born by ash) is treated by the combustion efficiency term, as are all air, leakage and combustion water terms. For accuracy considerations, stack losses (HSL) are not independently computed; however to clarify, they relate for example to $\eta_{C-HHV}$ as, using PTC 4.1 nomenclature in Eq. (25):

$$\eta_{C-HHV} = 1.0 - \frac{HSL_{HHV}}{HHVP + HBC} \quad (24)$$

$$HSL_{HHV} = [L_G + L_{mG} + L_{mF} + L_{mA} + L_{mCa} + L_Z + L_H + L_{CO} + L_{UH} + L_{UHC} + L_{UC1} + L_{UC2}]_{HHV} \quad (25)$$

where: the $L_{mG}$ term is moisture created from combustion of chemically-bound H/C fuel; $L_{mCa}$ is fuel moisture bound with effluent $CaSO_4$; $L_{UC1}$ is unburned carbon in fly ash; $L_{UC2}$ is unburned carbon in bottom ash; all others per PTC 4.1. Non-combustion energy flows are not included (see HNSL). Terms of Eq. (25) as fractions of (HHVP+HBC) or (LHVP+HBC), are computed after $\eta_C$, by back-calculation; they are presented only as secondary calculations for the monitoring of individual effects.

Combustion efficiency is determined by the following, as either HHV- or LHV-based:

$$\eta_{C-HHV} \equiv \frac{-HPR_{Act-HHV} + HRX_{Act-HHV}}{HHVP + HBC} \quad (26)$$

$$\eta_{C-LHV} \equiv \frac{-HPR_{Act-LHV} + HRX_{Act-LHV}}{LHVP + HBC} \quad (27)$$

The development of the combustion efficiency term, as computed based on $HPR_{Act}$ & $HRX_{Act}$ and involving systematic use of a combustion equation, such as Eq. (19), is believed an improved approach versus the primary use of individual "stack loss" terms. Mis-application of terms is greatly reduced. Numerical accuracy is increased. Most importantly, valid system mass and energy balances are assured.

Boiler efficiency is defined as either HHV- or LHV-based.

$$\eta_{B-HHV} = \eta_{C-HHV}\eta_A \quad (28)$$

$$\eta_{B-LHV} = \eta_{C-LHV}\eta_A \quad (29)$$

Of course fuel flow must compute identically from either efficiency base, thus:

$$m_{AF} = \frac{BBTC}{\eta_{B-HHV}(HHVP + HBC)} = \frac{BBTC}{\eta_{B-LHV}(LHVP + HBC)} \quad (30)$$

Such computations of fuel flow using either efficiency, at a defined $T_{Cal}$, is an important numerical overcheck of this invention.

After HNSL is computed, as observed in Eqs. (23), (26) & (27) only the three major terms $HPR_{Act}$, $HRX_{Act}$ & HBC remain to be defined to complete boiler efficiency. These are defined in the following paragraphs. To fully understand the formulations comprising $HPR_{Act}$, $HRX_{Act}$ & HBC, take note of the subscripts associated with the individual terms. For example, when considering water product created from combustion, $n_{Comb\text{-}H2O}$ of Eq. (31), its Heat of Formation (saturated liquid phase) at $T_{Cal}$ must be corrected for boundary (stack) conditions, thus, $h_{Stack}-h_{f\text{-}Cal}$ The Enthalpies of Reactants of Eqs. (34) & (35) are determined from ideal products at $T_{Cal}$, the Firing Correction then applied.

Differences in formulations required for higher or lower heating values should also be carefully reviewed. Higher heating values require use of the saturated liquid enthalpy evaluated at $T_{Cal}$; lower heating values require the use of saturated vapor at $T_{Cal}$. Water bound with effluent $CaSO_4$ is assumed in the liquid state at the stack temperature; whereas its reference is the heating value base (fuel water being the assumed source for $z[H_2O]$ of Eq. (19)). The quantities which are not so corrected are the last two terms in Eqs. (31) & (32): water born by air and from in-leakage undergo no transformations, having non-fuel origins. Heating values and energies used in Eqs. (31) thru (35) are always associated with the system boundary: the As-Fired fuel (or the "supplied" in the case of fuel rejects), ambient air and location of the Continuous Emission Monitoring System (CEMS) and temperature measurements (at the "stack").

Enthalpy of Products ($HPR_{Act}$)

For higher heating value calculations:

$$HPR_{Act-HHV}\equiv\Sigma HPR_i+[n_{Comb-H2O}(\Delta H_{f\text{-}Cal\text{-}liq}{}^{0}+h_{Stack}-h_{f\text{-}Cal})+n_{Fuel-H2O}(h_{Stack}-h_{f\text{-}Cal})+n_{Lime-H2O}(h_{f\text{-}Stack}-h_{f\text{-}Cal})+n_{CAir-H2O}(h_{Stack}-h_{g\text{-}Cal})+n_{Leak-H2O}(h_{Stack}-h_{Steam})]_{H2O}N_{H2O}/(xN_{AF}) \quad (31)$$

For lower heating value calculations:

$$HPR_{Act-LHV}\equiv\Sigma HPR_i+[n_{Comb-H2O}(\Delta H_{f\text{-}Cal/vap}{}^{0}+h_{Stack}-h_{g\text{-}Cal})+n_{Fuel-H2O}(h_{Stack}-h_{g\text{-}Cal})+n_{Lime-H2O}(h_{f\text{-}Stack}-h_{g\text{-}Cal})+n_{CAir-H2O}(h_{Stack}-h_{g\text{-}Cal})+n_{Leak-H2O}(h_{Stack}-h_{Steam})]_{H2O}N_{H2O}/(xN_{AF}) \quad (32)$$

where:

$HPR_1$ = Enthalpy of non-water product $i$ at the boundary $$\equiv\left[\Delta H^0_{f-Cal/i}+\int_{T_{Cal}}^{T_{Stack}} dh_i\right]n_iN_i/(xN_{AF}) \quad (33)$$

$n_{Comb-H2O}$ = Molar water found at the boundary from combustion $$\equiv x(\alpha_0ZR/2+\alpha_5+\alpha_9)-f$$

$n_{Fuel-H2O}$ = Molar water found at the boundary born by As-Fired fuel (as total inherent and surface moisture)

$$\equiv j_{Act}-[b_A+b_Z+\sigma b_{PLS}z+x(\alpha_0ZR/2+\alpha_5+\alpha_9)-f]$$

$n_{Lime-H2O}$ = Molar water bound with effluent $CaSO_4$ $$\equiv\sigma b_{PLS}z$$

$n_{CAir-H2O}$ = Molar water found at the boundary born by combustion air and air in-leakage $$\equiv b_A(1.0+\beta)$$

-continued $n_{Leak-H2O}$ = Molar water found at boundary from direct in-leakage $$\equiv b_Z$$

$h_{Stack-H2O}$ = $f(P_{stack-H2O}, T_{Stack})$, where $P_{Stack-H2O}$ is water's partial pressure per wet molar:

$$P_{Amb}(j_{Act}+\beta b_A)/(1.0+j_{Act}+\beta b_A).$$

Enthalpy of Reactants ($HRX_{Act}$)

For higher heating value calculations:

$$HRX_{Act-HHV}\equiv HHVP+HBC+HPR_{CO2-Ideal}+HPR_{SO2-Ideal}+[(\alpha_0ZR/2+\alpha_5+\alpha_9)(\Delta H_{f\text{-}Cal/liq}{}^{0}N)_{H2O}/N_{AF}]+HRX_{CaCO3} \quad (34)$$

For lower heating value calculations:

$$HRX_{Act-LHV}\equiv LHVP+HBC+HPR_{CO2-Ideal}+HPR_{SO2-Ideal}+[(\alpha_0ZR/2+\alpha_5+\alpha_9)(\Delta H_{f\text{-}Cal/vap}{}^{0}N)_{H2O}/N_{AF}]+HRX_{CaCO3} \quad (35)$$

where:

$HPR_{CO2-Ideal}$ = Energy of $CO_2$ ideal product from complete combustion at the calibration temperature.

$$\equiv\Delta H^0_{f-Cal/CO2}(\alpha_0YR+\alpha_4+\alpha_8)N_{CO2}/N_{AF}$$

$HPR_{SO2-Ideal}$ = Energy of $SO_2$ ideal product from complete combustion at the calibration temperature.

$$\equiv\Delta H^0_{f-Cal/SO_2}(\alpha_6+\alpha_9)N_{SO_2}/N_{AF}$$

$HPR_{H2O-Ideal}$ = Energy of $H_2O$ ideal product from complete combustion at the calibration temperature.

$$\equiv(\alpha_0ZR/2+\alpha_5+\alpha_9)(\Delta H^0_{f-Cal/liq}N)_{H2O}/N_{AF};$$

for $HHV$ $$\equiv(\alpha_0ZR/2+\alpha_5+\alpha_9)(\Delta H^0_{f-Cal/vap}N)_{H2O}/N_{AF};$$

for $LHV$.

$HRX_{CaCO3}$ = Energy of injected pure limestone, $CaCO_3$, at the calibration temperature; use of $\Delta H^0_{f-Cal/CaCO3}$ anticipates Heats of Formation associated with limestone products appearing in Eq. (33).

$$\equiv\Delta H^0_{f-Cal/CaCO3}b_{PLS}(1.0+\gamma)N_{CaCO3}/(xN_{AF})$$

Firing Correction (HBC)

$$HBC\equiv C_P(T_{AF}-T_{Cal})_{Fuel}+(Q_{SAH}+W_{FD})/m_{AF}+[(h_{Amb}-h_{Cal})_{Air}a(1.0+\beta)(1.0+\phi_{Act})N_{Air}+(h_{g\text{-}Amb}-h_{g\text{-}Cal})_{H2O}b_A(1.0+\beta)N_{H2O}+(h_{Steam}-h_{f\text{-}Cal})_{H2O}b_ZN_{H2O}+C_P(T_{Amb}-T_{Cal})_{PLS}b_{PLS}(1.0+\gamma)N_{CaCO3}]/(xN_{AF}) \quad (36)$$

where:

$h_{g-Amb-H2O}$=Saturated water enthalpy at ambient dry bulb, $T_{Amb}$. $(h_{Amb}-h_{Cal})_{Air}$=ΔEnthalpy of combustion dry air relative to $T_{Cal}$.

$(h_{g\text{-}Amb}-h_{g\text{-}Cal})_{H2O}$=ΔEnthalpy of moisture in combustion air relative to saturated vapor at $T_{Cal}$.

$(h_{Steam}-h_{f\text{-}Cal})_{H2O}$=ΔEnthalpy of water in-leakage to system relative to saturated liquid at $T_{Cal}$.

$C_P(T_{Amb}-T_{Cal})_{PLS}$=ΔEnthalpy of pure limestone relative to $T_{Cal}$.

The above equations are dependent on common system parameters. Common system parameters are defined following their respective equations, Eqs. (31) thru (36). Further, these terms are discussed in PTC 4.1 and 4, and throughout U.S. Pat. No. 5,790,420. In addition, the BBTC term, also comprising common system parameters, is determined from commonly measured or determined working fluid mass flow rates, pressures and temperatures (or qualities).

Miscellaneous Calculations

Several PTCs and "coal" textbooks employ simplifying assumptions regarding the conversion of heating values. For example, a constant is sometimes used to convert from a constant volume process HHV (i.e., bomb calorimeter), to a constant pressure process HHVP. The following is preferred for completeness, for solid and liquid fuels, and is also applicable for LHV:

$$HHVP=HHV+\Delta H_{V/P} \tag{37A}$$

$$\Delta H_{V/P}=RT_{Cal,Abs}(\alpha_5/2-\alpha_1)/(\xi JN_{AF}) \tag{37B}$$

where, in US Customary Units: $T_{Cal,Abs}$ is absolute temperature (deg−R); R=1545.325 ft-lbf/mole-R; and J=778.169 ft-lbf/Btu. For gaseous fuels, the only needed correction is the compressibility factor assuming ideally computed heating values:

$$HHVP=HHV_{Ideal}Z \tag{38}$$

Z and $HHV_{Ideal}$ are evaluated using American Gas Association procedures.

To convert from a higher (gross) to a lower (net) heating value use of Eq. (39B) is exact, where $\Delta h_{fg-Cal/H2O}$ is evaluated at $T_{Cal}$. The oxygen in the effluent water is assumed to derive from combustion air, and not fuel oxygen (thus $\alpha_3$ is not included).

$$LHV=HHV-\Delta H_{L/H} \tag{39A}$$

$$\Delta H_{L/H}=\Delta h_{fg-Cal/H2O}(\alpha_0 ZR/2+\alpha_2+\alpha_5+\alpha_9)N_{H2O}/(\xi N_{AF}) \tag{39B}$$

Discussion of Flow Diagram

To more fully explain this invention FIG. 1 is presented. Box 20 of FIG. 1 represents the determination of a fossil fuel's heating value, and its correction if needed for a constant pressure process using Eqs. (37A) & (37B). If a gaseous fuel, determination of HHVP is generally a computation, establishing $T_{Cal}$ by convention; in North America 60 F is commonly used. If a solid or liquid fuel, whose heating value is tested by bomb calorimeter, $T_{Cal}$ is measured and/or otherwise established as part of the testing procedure. Box 22 describes the calculation of the $HPR_{Ideal}$ term, comprising $HPR_{CO2-Ideal}$, $HPR_{SO2-Ideal}$ and $HPR_{H2O[l]m]-Ideal}$, expressed below Eq. (35) where associated Heats of Formation are computed from Eq. (18) at $T_{Cal}$. Box 30 describes the computation of the Firing Correction term, HBC, using Eq. (36) as referenced to $T_{Cal}$ Box 32 represents the calculation of the uncorrected Enthalpy of Reactants evaluated at $T_{Cal}$, from Eq. (2B) requiring results from Boxes 20 and 22. Box 40 represents the calculation of the Enthalpy of Reactants at actual firing conditions using Eqs. (34) or (35), requiring input from Boxes 30 and 32. Box 42 represents the calculation of the Enthalpy of Products at actual boundary exit conditions (e.g., stack temperature), using Eq. (31) or (32). Box 44 represents the calculation of the non-chemistry & sensible heat loss term, HNSL, using Eq. (20) whose procedures and individual terms are herein discussed. Box 50 represents the computation of combustion efficiency, using either Eq. (26) or (27), with inputs from Boxes 20, 30, 40, and 42. Box 52 represents the computation of boiler absorption efficiency, using either form of Eq. (23), with inputs from Boxes 40, 42 and 44. Box 54 represents the computation of boiler efficiency, using either Eq. (28) or (29), with inputs from Boxes 50 and 52.

Typical Results

The following presents typical numerical results as evaluated by the EX-FOSS computer program, commercially available from Exergetic Systems, Inc., of San Rafael, Calif. which has now been modified to employ the methods of this invention.

To illustrate the effects of mis-using calorimetric temperature Table 1 presents the results of a methane-burning boiler. As observed, boiler efficiency is insensitive to slight changes in heating values provided $T_{Cal}$ is not varied in other terms comprising $\eta_B$. However, when consistently altering $T_{Cal}$ (as its impacts $HPR_{Ideal}$), results indicate serious, and un-reasonable, error in boiler efficiency. One may not establish a reference temperature for the fuel's chemical energy, at $T_{Cal}$, and then not consistently apply it to other energy terms. If misapplied as suggested by Table 1, errors in ri and system heat rate will be assured. Use of Eq. (15), given $\eta_B$ derives from Eq. (10) & (11), demands consistency in the $HPR_{Act}$, $HRX_{Act}$ and HBC terms; the same system can not have a difference in its computed fuel flow.

TABLE 1

Calorimetric Temperature Effects on Boiler Efficiency

| Computed Heating Value for Methane | Efficiency at 77 F. | Efficiency at 60 F. | True Effect, $\Delta\eta_{B\text{-}HHV}$ |
|---|---|---|---|
| 23867.31 at 77 F. | 83.318% | 82.893% | −0.425% |
| 23891.01 at 60 F. | 83.333% | 82.908% | −0.425% |
| Difference in efficiency if ignoring $T_{Cal}$ (HHV effects only) | −0.015% | −0.015% | |

Table 2 presents typical effects on boiler efficiency and system heat rate of mis-use of calorimetric temperatures on a variety of coal-fired power plants. The effect of such mis-use are considered un-reasonable. These computations are based on EX-FOSS, varying only $T_{Cal}$. Data was obtained from actual plant conditions.

TABLE 2

Effects on Boiler Efficiency and System Heat Rate of Mis-Use of Calorimetric Temperature

| Unit | $T_{Cal}$ = 77 F. | $T_{Cal}$ = 68 F. | True Effect, $\Delta\eta_B$ | True Effect, ΔHR/HR |
|---|---|---|---|---|
| 110 MWe CFB coal w/Limestone | 86.086% | 85.874% | −0.212% | +0.237% |
| 300 MWe Lignite-B, Lower Heating Value | 78.771% | 78.426% | −0.345% | +0.438% |
| 800 MWe Coal Slurry | 81.364% | 81.099% | −0.265% | +0.335% |

Table 3 lists computational overchecks of higher and lower heating value calculations, verifying that the computed fuel flow rates of Eq. (30), are numerically identical.

These simulations were selected from Input/Loss' installed base as having unusual complexity, based on actual plant conditions. The only changes in these simulations was input of HHV or LHV, and an EX-FOSS option flag; LHV or HHV are automatically computed by EX-FOSS given input of the other.

TABLE 3

EX-FOSS Calculational Overchecks (efficiencies & fuel flow, lbm/hr)

| Unit | HHV Eff. & Flow | LHV Eff. & Flow |
|---|---|---|
| 300 MWe | 59.104% | 78.426% |
| Lignite-B | 1,383,259.9 | 1,383,260.0 |
| 800 MWe | 81.097% | 88.761% |
| Coal Slurry | 1,104,329.4 | 1,104,329.7 |

Several modern bomb calorimetric instruments are automated to run at $T_{Cal}$=95F (35C). The repeatability accuracy of these instruments is between ±0.07% to ±0.10%. Modern bomb calorimeters use benzoic acid powder for calibration testing. Calibration results are typically analyzed using the well-known Washburn corrections (*Journal of Physical Chemistry*, Volume 58, pp.152–162, 1954). Based on these procedures, NIST Standard Reference Material 39j certification for benzoic acid makes a multiplicative correction for temperature: [$1.0–45.0\times10^{-6}$ ($T_{Cal}$–25° C.)]. Such corrective coefficients (e.g., $45.0\times10^{-6}$) were computed for a number of coals, using average chemistries for different coal Ranks, and with methane. For example, a correction of $122\times10^{-6}$ implies a 0.122% change in HHV over 10° C. As observed below in Table 4, heating values with increasing fuel moisture are generally increasingly sensitive to calorimetric temperature, especially for gaseous fuels and poor quality lignite coals. Effects on HHVs associated with the common coals are not great. However, the sensitivity of temperature on $HPR_{Ideal}$ is appreciable for most Ranks; computed using EX-FOSS. This sensitivity demonstrates the fundamental cause for the sensitivities observed in Tables 1 and 2.

TABLE 4

Temperature Coefficients for Meating Value Corrections and $HPR_{Ideal}$ Temperature Sensitivity

| Coal Rank | Fuel Water | Fuel Ash | Avg HHV at 25 C. | HHV Temp Coef. ($\times10^{-6}/1\Delta C$) | $\Delta HPR_{Ideal}$ / $HPR_{Ideal}$ ($\times10^{-6}/1\Delta C$) |
|---|---|---|---|---|---|
| an | 3.55 | 9.85 | 12799.75 | 19.56 | 376.6 |
| sa | 1.44 | 16.51 | 12466.17 | 30.10 | 285.0 |
| lvb | 1.74 | 13.24 | 13087.76 | 39.22 | 347.7 |
| mvb | 1.75 | 11.48 | 13371.75 | 41.88 | 380.5 |
| hvAb | 2.39 | 10.86 | 13031.61 | 47.77 | 444.2 |
| hvBb | 5.61 | 11.83 | 11852.63 | 56.53 | 446.7 |
| hvCb | 9.89 | 12.32 | 10720.40 | 60.18 | 450.6 |
| subA | 12.85 | 8.71 | 10292.89 | 51.16 | 398.3 |
| subB | 17.87 | 9.57 | 9259.75 | 61.15 | 408.0 |
| subC | 23.79 | 10.67 | 8168.69 | 75.14 | 423.3 |
| ligA | 29.83 | 9.64 | 7294.66 | 83.56 | 439.4 |
| ligB-P | 28.84 | 22.95 | 4751.83 | 122.17 | 481.3 |
| ligB-G | 54.04 | 19.30 | 2926.82 | 246.01 | 685.2 |
| Methane | .00 | .00 | 23867.31 | 105.39 | 424.3 |
| Benzoic | .00 | .00 | 11372.40 | 45.00 | 392.6 |

The method of this invention generally causes an insensitivity in computed fuel flow when using an arbitrary reference temperature over a reasonable range. Table 5 demonstrates this for several coal Ranks, assuming $T_{RA}$ changed from 68F to 77F, and from 68F to 95F. Such effects on fuel flow are additive to those associated with boiler efficiency when considering net effects on system heat rate (system efficiency).

TABLE 5

Effect of Computed Fuel Flow, Eq.(15), Given Changes to Reference Temperature

| Coal Rank | Effect on Fuel Flow ($T_{RA}$ = 68 to 77 F.) | Effect of Fuel Flow ($T_{RA}$ = 68 to 95 F.) |
|---|---|---|
| an | +0.0051% | +0.0148% |
| hvCb | −0.0251% | −0.0758% |
| subC | −0.0273% | −0.0824% |
| ligB | −0.1118% | −0.3371% |

The results illustrated in Tables 1, 2 and 4 indicate generally un-reasonable sensitivity in computed boiler efficiency and system heat rate. Considered reasonable accuracy as attainable using the methods of this invention, are $\Delta\eta_{B-HHV}$ errors, or $\Delta\eta_{B-LHV}$ errors, in boiler efficiency of 0.15% $\Delta\eta_B$ or less. Considered reasonable accuracy in computed system heat rate are ΔHR/HR errors no greater than 0.25%. Considered reasonable accuracy in computed fuel flow, using Eq. (15), are $\Delta m_{AF}/m_{AF}$ errors no greater than 0.10%.

Summary

This work demonstrates a systemic approach to determining boiler efficiency. It demonstrates that the concept of defining boiler efficiency in terms of the Enthalpy of Products ($HPR_{Act}$), the Enthalpy Reactants ($HRX_{Act}$) and the Firing Correction (HBC), it is believed, provides enhanced accuracy when these major boiler efficiency terms are referenced to the same calorimetric temperature. Such accuracy is needed by the Input/Loss Method, and for the improvement of fossil combustion in a competitive marketplace. The $HPR_{Act}$ & $HRX_{Act}$ concept forces an integration of combustion effluents with fuel chemistry through stoichiometrics.

What is claimed is:

1. A method for determining a higher heating value boiler efficiency for a thermal system which applies consistently a fuel's calorimetric temperature, comprising the steps of:

(a) determining a fuel's higher heating value and the associated calorimetric temperature;

(b) equating a thermodynamic reference temperature used to evaluate a boiler's energy flows, to the calorimetric temperature as established when determining the fuel's higher heating value;

(c) calculating an Enthalpy of Products, an Enthalpy of Reactants and a Firing Correction as a function of the fuel's higher heating value, common system parameters, and the thermodynamic reference temperature;

(d) calculating the combustion efficiency as a function of the higher heating value, the Enthalpy of Products, the Enthalpy of Reactants, and the Firing Correction;

(e) calculating a boiler efficiency from the combustion efficiency and a boiler absorption efficiency;

(f) calculating a fuel flow to the thermal system from the boiler efficiency, an energy delivered from the combustion process, the fuel's higher heating value and the Firing Correction; and (g) calculating an effluent flow output from the thermal system from the fuel flow and system stoichiometrics.

2. A method for determining higher heating value boiler efficiency for a thermal system which applies consistently any thermodynamic reference temperature, comprising the steps of:

(a) determining a fuel's higher heating value;

(b) using any thermodynamic reference temperature to evaluate a boiler's energy flows, wherein a reasonable change in the thermodynamic reference temperature does not substantially affect a computed boiler efficiency or a computed fuel flow;

(c) calculating an Enthalpy of Products, an Enthalpy of Reactants and a Firing Correction as a function of the fuel's higher heating value, common system parameters, and the thermodynamic reference temperature;

(d) calculating the combustion efficiency as a function of the higher heating value, the Enthalpy of Products, the Enthalpy of Reactants, and the Firing Correction;

(e) calculating a boiler efficiency from the combustion efficiency and a boiler absorption efficiency;

(f) calculating a fuel flow to the thermal system from the boiler efficiency, an energy delivered from the combustion process, the fuel's higher heating value and the Firing Correction; and (g) calculating an effluent flow output from the thermal system using the fuel flow and system stoichiometrics.

3. A method for determining higher heating value boiler efficiency, comprising the concept of using a fuel's calorimetric temperature for the thermodynamic reference energy level of an Enthalpy of Products term, for the thermodynamic reference energy level of an Enthalpy of Reactants term, and also for the thermodynamic reference energy level of a Firing Correction term evaluated independent of a fuel flow and an effluent flow, said terms comprising the major terms of a computed boiler efficiency.

4. A method for determining a lower heating value boiler efficiency for a thermal system which applies consistently a fuel's calorimetric temperature, comprising the steps of:

(a) determining a fuel's lower heating value and the associated calorimetric temperature;

(b) equating a thermodynamic reference temperature used to evaluate a boiler's energy flows, to the calorimetric temperature as established when determining the fuel's lower heating value;

(c) calculating an Enthalpy of Products, an Enthalpy of Reactants and a Firing Correction as a function of the fuel's lower heating value, common system parameters, and the thermodynamic reference temperature;

(d) calculating the combustion efficiency as a function of the lower heating value, the Enthalpy of Products, the Enthalpy of Reactants, and the Firing Correction;

(e) calculating a boiler efficiency from the combustion efficiency and a boiler absorption efficiency;

(f) calculating a fuel flow to the thermal system from the boiler efficiency, an energy delivered from the combustion process, the fuel's lower heating value and the Firing Correction; and (g) calculating an effluent flow output from the thermal system from the fuel flow and system stoichiometrics.

5. A method for determining lower heating value boiler efficiency for a thermal system which applies consistently any thermodynamic reference temperature, comprising the steps of:

(a) determining a fuel's lower heating value;

(b) using any thermodynamic reference temperature to evaluate a boiler's energy flows, wherein a reasonable change in the thermodynamic reference temperature does not substantially affect a computed boiler efficiency or a computed fuel flow;

(c) calculating an Enthalpy of Products, an Enthalpy of Reactants and a Firing Correction as a function of the fuel's lower heating value, common system parameters, and the thermodynamic reference temperature;

(d) calculating the combustion efficiency as a function of the lower heating value, the Enthalpy of Products, the Enthalpy of Reactants, and the Firing Correction;

(e) calculating a boiler efficiency from the combustion efficiency and a boiler absorption efficiency;

(f) calculating a fuel flow to the thermal system from the boiler efficiency, an energy delivered from the combustion process, the fuel's lower heating value and the Firing Correction; and (g) calculating an effluent flow output from the thermal system using the fuel flow and system stoichiometrics.

6. A method for determining lower heating value boiler efficiency, comprising the concept of using a fuel's calorimetric temperature for the thermodynamic reference energy level of an Enthalpy of Products term, for the thermodynamic reference energy level of an Enthalpy of Reactants term, and also for the thermodynamic reference energy level of a Firing Correction term evaluated independent of a fuel flow and an effluent flow, said terms comprising the major terms of a computed boiler efficiency.

7. A method to evaluate either higher or lower heating value efficiencies such that their computed fuel flows are not sensitive to reasonable changes in a thermodynamic reference temperature used to determine the energy level of an Enthalpy of Products term, used to determine the energy level of an Enthalpy of Reactants term, and also used to determine the energy level of a Firing Correction term evaluated independent of a fuel flow and an effluent flow, said terms comprising the major terms of a computed boiler efficiency.

8. A method to evaluate either higher or lower heating value efficiencies such that their computed fuel flows are the same, comprising the steps of:

(a) determining a fuel's higher heating value;

(b) calculating an Enthalpy of Products and an Enthalpy of Reactants based on the fuel's higher heating value, common system parameters and a thermodynamic reference temperature;

(c) calculating a Firing Correction based on common system parameters and a thermodynamic reference temperature;

(d) calculating the difference between the Enthalpy of Products and the Enthalpy of Reactants, both based on the fuels' higher heating value;

(e) calculating the higher heating value combustion efficiency as a function of the fuel's higher heating value, the difference in the Enthalpy of Products and the Enthalpy of Reactants as based on the fuel's higher heating value, and the Firing Correction;

(f) calculating a higher heating value boiler efficiency from the higher heating value combustion efficiency and a boiler absorption efficiency;

(g) determining a fuel's lower heating value;

(h) calculating an Enthalpy of Products and an Enthalpy of Reactants based on the fuel's lower heating value, common system parameters and a thermodynamic reference temperature;

(i) calculating a Firing Correction based on common system parameters and a thermodynamic reference temperature;

(j) calculating the difference between the Enthalpy of Products and the Enthalpy of Reactants, both based on the fuels' lower heating value;

(k) calculating the lower heating value combustion efficiency as a function of the fuel's lower heating value, the difference in the Enthalpy of Products and the Enthalpy of Reactants as based on the fuel's lower heating value, and the Firing Correction;

(l) calculating a lower heating value boiler efficiency from the lower heating value combustion efficiency and a boiler absorption efficiency;

(m) calculating a fuel flow to the thermal system from either the higher heating value boiler efficiency of step (f), an energy delivered from the combustion process, the fuel's higher heating value and the Firing Correction, or from the lower heating value boiler efficiency of step (l), an energy delivered from the combustion process, the fuel's lower heating value and the Firing Correction, such that these fuel flows are the same.

9. A method for determining a higher heating value boiler efficiency for a thermal system which applies consistently a fuel's calorimetric temperature, comprising the steps of:

(a) determining a fuel's higher heating value and the associated calorimetric temperature;

(b) equating a thermodynamic reference temperature used to determine the energy levels of the major terms of computed boiler efficiency, to the calorimetric temperature as established when determining the fuel's higher heating value;

(c) calculating an Enthalpy of Products, an Enthalpy of Reactants, and a Firing Correction as a function of the fuel's higher heating value, common system parameters, and the thermodynamic reference temperature;

(d) determining a set of losses effecting computed boiler efficiency;

(d) calculating a boiler efficiency as a function of the higher heating value, the Enthalpy of Products, the Enthalpy of Reactants, the Firing Correction, and the set of losses; and (e) reporting the boiler efficiency.

10. The method of claim 9, further comprising an additional step, after the step of reporting, of:

(f) calculating a fuel flow to the thermal system based on the boiler efficiency, an energy flow delivered from the combustion process, the fuel's higher heating value, and the Firing Correction.

11. The method of claim 10, further comprising an additional step, after the step of calculating the fuel flow, of:

(g) calculating an effluent flow output from the thermal system based on the fuel flow and system stoichiometrics.

12. A method for determining a lower heating value boiler efficiency for a thermal system which applies consistently a fuel's calorimetric temperature, comprising the steps of:

(a) determining a fuel's lower heating value and the associated calorimetric temperature;

(b) equating a thermodynamic reference temperature used to determine the energy levels of the major terms of computed boiler efficiency, to the calorimetric temperature as established when determining the fuel's lower heating value;

(c) calculating an Enthalpy of Products, an Enthalpy of Reactants, and a Firing Correction as a function of the fuel's lower heating value, common system parameters, and the thermodynamic reference temperature;

(d) determining a set of losses effecting computed boiler efficiency;

(d) calculating a boiler efficiency as a function of the lower heating value, the Enthalpy of Products, the Enthalpy of Reactants, the Firing Correction, and the set of losses; and (e) reporting the boiler efficiency.

13. The method of claim 12, further comprising an additional step, after the step of reporting, of:

(f) calculating a fuel flow to the thermal system based on the boiler efficiency, an energy flow delivered from the combustion process, the fuel's lower heating value, and the Firing Correction.

14. The method of claim 13, further comprising an additional step, after the step of calculating the fuel flow, of:

(g) calculating an effluent flow output from the thermal system based on the fuel flow and system stoichiometrics.

* * * * *

UNITED STATES PATENT AND TRADEMARK OFFICE

CERTIFICATE OF CORRECTION

PATENT NO. : 6,584,429 B1
DATED : June 24, 2003
INVENTOR(S) : Fred D. Lang

It is certified that error appears in the above-identified patent and that said Letters Patent is hereby corrected as shown below:

Column 2,
Line 52, delete "(1A) Higher" and insert -- (1A). Higher --
Line 56, delete "water jacket, about" and insert -- water jacket, --

Equation (2A) should read as follows:

$$\oint \delta Q_{T\text{-}Cal} = -\,HHV = -\,HHVP + \Delta H_{V/P} \qquad (2A)$$

Equation (2B) should read as follows:

$$HHVP \equiv -\,HPR_{Ideal} + HRX_{Cal} \qquad (2B)$$

Column 3,
Line 24, delete "being produced at $T_{Cal}$)." and insert -- are produced at $T_{Cal}$). --

Columns 4 through 16,
Each occurrence of a Heat of Formulation in the form "$\Delta H_{f\text{-}Cal}{}^{0}$" should read -- $\Delta H^{0}_{f\text{-}Cal}$ --

Column 5,
Equation (8) should read as follows:

$$\eta_B = \frac{\begin{array}{l} -\,HPR_{Ideal} - C_{P/Gas}(T_{Stack} - T_{RA})M'_{Gas} - W_{ID} \\ -\,(-\,\Delta H^{0}_{f\text{-}Cal/CO2} + \Delta H^{0}_{f\text{-}Cal/CO})M'_{CO} \\ -\,(-\Delta H^{0}_{f\text{-}Cal/CO2})M'_{C/Fly} + [HRX_{Cal} + C_{P/Fuel}(T_{Fuel} - T_{RA}) \\ +\,C_{P/Air}(T_{Amb} - T_{RA})M'_{Air} + W_{FD}] \end{array}}{HHVP + HBC'} \qquad (8)$$

Line 22, delete "HBC referenced to $T_{RA}$" and insert -- a HBC' referenced to $T_{RA}$" --

Column 6,
Line 4, delete "ideal arid actual" and insert -- ideal and actual --
Lines 10-11, delete "the last line of Eq. (8);" and insert -- the bracketed terms in the numerator of Eq. (8); --
Line 18, delete "(cornionly" and insert -- (commonly --

UNITED STATES PATENT AND TRADEMARK OFFICE

CERTIFICATE OF CORRECTION

PATENT NO. : 6,584,429 B1
DATED : June 24, 2003
INVENTOR(S) : Fred D. Lang

It is certified that error appears in the above-identified patent and that said Letters Patent is hereby corrected as shown below:

Column 7,
Line 37, delete "Ouantities" and insert -- Quantities --

Column 8,
Line 21, delete "$T_{Slack}$ = Boundary temperature" and insert -- $T_{Stack}$ = Boundary temperature --

Column 9,
Line 1, delete "$RRX_{Act}$" and insert -- $HRX_{Act}$ --

Column 10,
Line 25, embedded equation "$\eta_B = f(T_{RA})$" should read -- $\eta_B = f(T_{RA})$ --
Line 27, delete "$\eta_B$" and insert -- $T_{RA}$ through $\eta_B$ --

Column 11,
Lines 10-11, delete "Industrial Enginee Chemistry, Process Desin and Development" and insert -- Industrial Engineer Chemistry, Process Design and Development --

Column 12,
Line 46, embedded equation "$\alpha_{10\text{-}corr}=f(WF'_{Ash\text{-}AF})$" should read -- $\alpha_{10\text{-corr}}=f(WF'_{Ash\text{-}AF})$ --

Column 15,
Line 48, delete "$HPR_1$ = Enthalpy of non-water product *i* at the boundary" and insert -- $HPR_i$ = Enthalpy of non-water product *i* at the boundary --

Column 16,
Lines 65-67, listed equations should read as follows:
-- $h_{g\text{-}Amb\text{-}H2O}$ = Saturated water enthalpy at ambient dry bulb, $T_{Amb}$.
$(h_{Amb} - h_{Cal})_{Air}$ = ΔEnthalpy of combustion dry air relative to $T_{Cal}$.--

Column 17,
Line 29, delete "(deg-R); R = 1545.325 ft-lbf/mole-R" and insert -- (deg-Rankin); R = 1545.325 ft-lbf/mole-Rankin --
Line 58, delete the term "$HPR_{H2O[|m]\text{-}Ideal}$" and insert -- $HPR_{H2O\text{-}Ideal}$ --
Line 61, delete "$T_{Cal}$ Box 32" and insert -- $T_{Cal.}$ Box 32 --

UNITED STATES PATENT AND TRADEMARK OFFICE

CERTIFICATE OF CORRECTION

PATENT NO. : 6,584,429 B1
DATED : June 24, 2003
INVENTOR(S) : Fred D. Lang

It is certified that error appears in the above-identified patent and that said Letters Patent is hereby corrected as shown below:

Column 18,
Line 27, delete "errors in ri and" and insert -- errors in $\eta_B$ and --

Column 19,
Line 45, delete "Meating Value" and insert -- Heating Value --

Signed and Sealed this

Ninth Day of September, 2003

JAMES E. ROGAN
*Director of the United States Patent and Trademark Office*